US007241154B1

(12) United States Patent
Mauney et al.

(10) Patent No.: US 7,241,154 B1
(45) Date of Patent: Jul. 10, 2007

(54) JUNCTION BLOCK ASSEMBLY WITH CAM LEVERS

(75) Inventors: Joseph Mauney, South Lyon, MI (US); J. Patrick Dunbar, Westland, MI (US); Mark Christian, Royal Oak, MI (US)

(73) Assignee: Sumitomo Electrical Wiring Systems - Detroit Technical Center, Inc., Northville, MI (US)

( * ) Notice: Subject to any disclaimer, the term of this patent is extended or adjusted under 35 U.S.C. 154(b) by 0 days.

(21) Appl. No.: 11/415,128

(22) Filed: May 2, 2006

(51) Int. Cl.
*H01R 13/62* (2006.01)

(52) U.S. Cl. ..... 439/157

(58) Field of Classification Search ..... 439/157, 439/372, 342, 376, 160, 34
See application file for complete search history.

(56) References Cited

U.S. PATENT DOCUMENTS 2,430,011 A 11/1947 Gillentine
5,035,634 A * 7/1991 Hasircoglu et al. ..... 439/157
5,873,745 A * 2/1999 Duclos et al. ..... 439/157
6,254,414 B1 7/2001 Sawayanagi et al.
6,500,015 B2 12/2002 Fukamachi et al.
6,739,889 B1 * 5/2004 Daggett et al. ..... 439/157
7,094,081 B1 * 8/2006 Senk et al. ..... 439/157
2003/0124884 A1 7/2003 Katsumata et al.
2003/0211764 A1 11/2003 Fukamachi et al.

FOREIGN PATENT DOCUMENTS

JP A 8-47142 2/1996
JP A 2000-13954 1/2000

* cited by examiner

*Primary Examiner*—Tho D. Ta
*Assistant Examiner*—Vanessa Girardi
(74) *Attorney, Agent, or Firm*—Oliff & Berridge, PLC

(57) ABSTRACT

A junction block assembly includes a junction block holding at least two first connectors, and at least two second connectors that mate with the first connectors. To reduce the force required to assemble the connectors, first and second cam levers are rotatably mounted to the junction block. The first and second cam levers each engage one of the second connectors and pull the engaged second connector into connection with a mating one of the first connectors. An arm of the second cam lever travels past an arm of the first cam lever during rotation.

8 Claims, 5 Drawing Sheets

JUNCTION BLOCK ASSEMBLY WITH CAM LEVERS

BACKGROUND

This invention relates to a junction block assembly, such as an electrical connection box assembly mounted on a vehicle or the like.

In various assembly processes, such as automobile assembly processes, many cable connections must be made, e.g., within the electrical system of a vehicle. Connections are often made using connectors, such as plug-in-type connectors. In some configurations, it is difficult to see whether proper alignment of the connectors has been achieved prior to pressing the connectors together. If the alignment is incorrect, damage to components such as terminal pins or surrounding plastic parts, and/or improper connection resulting in a "no-start" condition, can occur. Additionally, it is sometimes difficult for an assembly technician to determine whether the connectors have been completely engaged with each other.

Force multiplying technology has been applied to connectors to reduce the actual force that must be applied by a human operator to connect connectors together. For example, in some assemblies, a cam lever fixed relative to one connector includes a cam groove that engages a cam post fixed relative to a mating connector. When the cam lever is rotated, the interaction of the cam groove and cam post pulls the connectors into engagement with each other.

SUMMARY

However, when several pairs of mating connectors are placed side by side, it may become problematic, in some configurations, to use such cam levers, because the cam lever for one pair of connectors may interfere with the cam lever for an adjacent pair of connectors.

To address this situation, exemplary embodiments of this invention provide a junction block assembly, including a junction block holding at least two first connectors, at least two second connectors that mate with the first connectors, and first and second cam levers rotatably mounted to the junction block. The first cam lever engages one of the second connectors and pulls the engaged second connector into connection with a mating one of the first connectors, and the second cam lever engages one of the second connectors and pulls the engaged second connector into connection with a mating one of the first connectors. An arm of the second cam lever travels past an arm of the first cam lever during rotation. The second connectors may move independently of each other while being pulled into connection with mating ones of the first connectors.

Because the arm of the second cam lever travels past an arm of the first cam lever during rotation, a compact configuration can be achieved, while maintaining the advantage of providing a concentrated engaging force at each of the second connectors individually.

Additionally, from the position of the cam levers and/or cam pins, the assembly technician can easily determine whether proper alignment has been achieved, and whether the first and second connectors have been completely engaged with each other.

These and other objects, advantages and features of the invention are described in or apparent from the following description of embodiments.

BRIEF DESCRIPTION OF THE DRAWINGS

Exemplary embodiments will be described with reference to the accompanying drawings, in which like numerals represent like parts, and wherein.

DETAILED DESCRIPTION OF EMBODIMENTS

Figure 1:
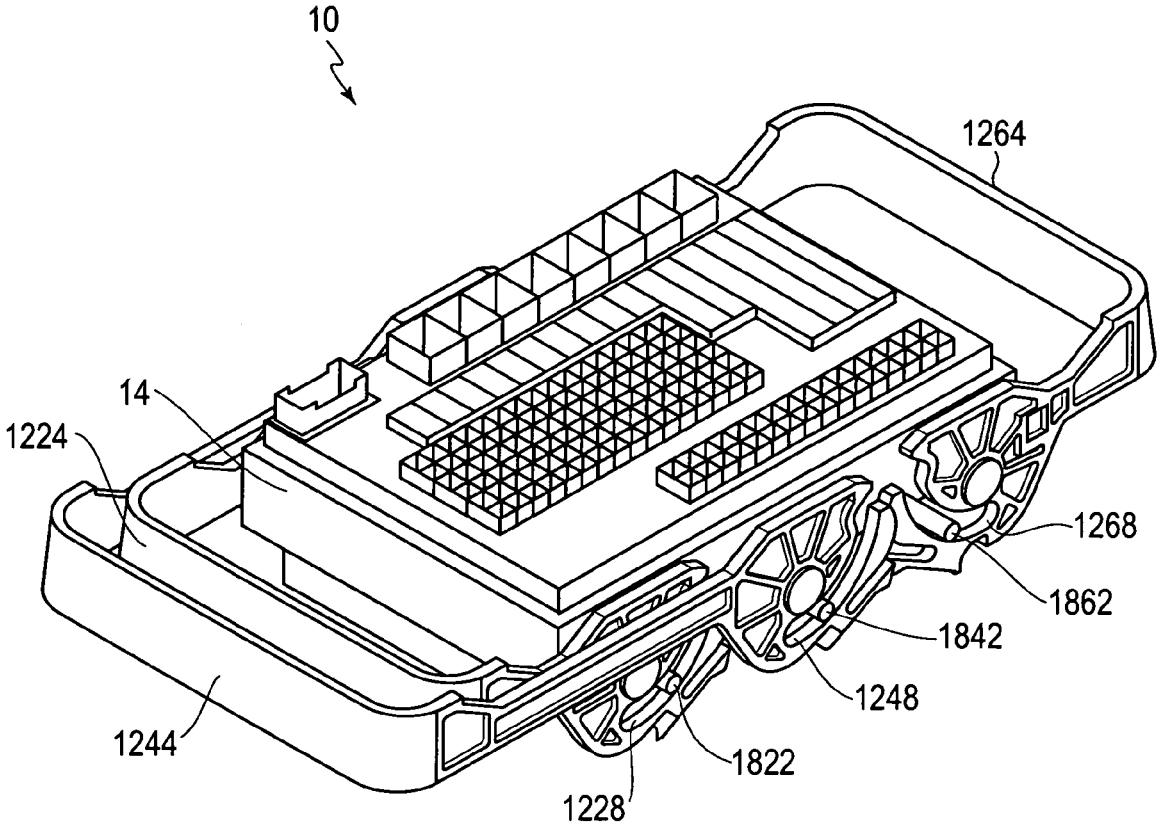
FIG. 1 is a perspective view of a junction block assembly.
Figure 2:
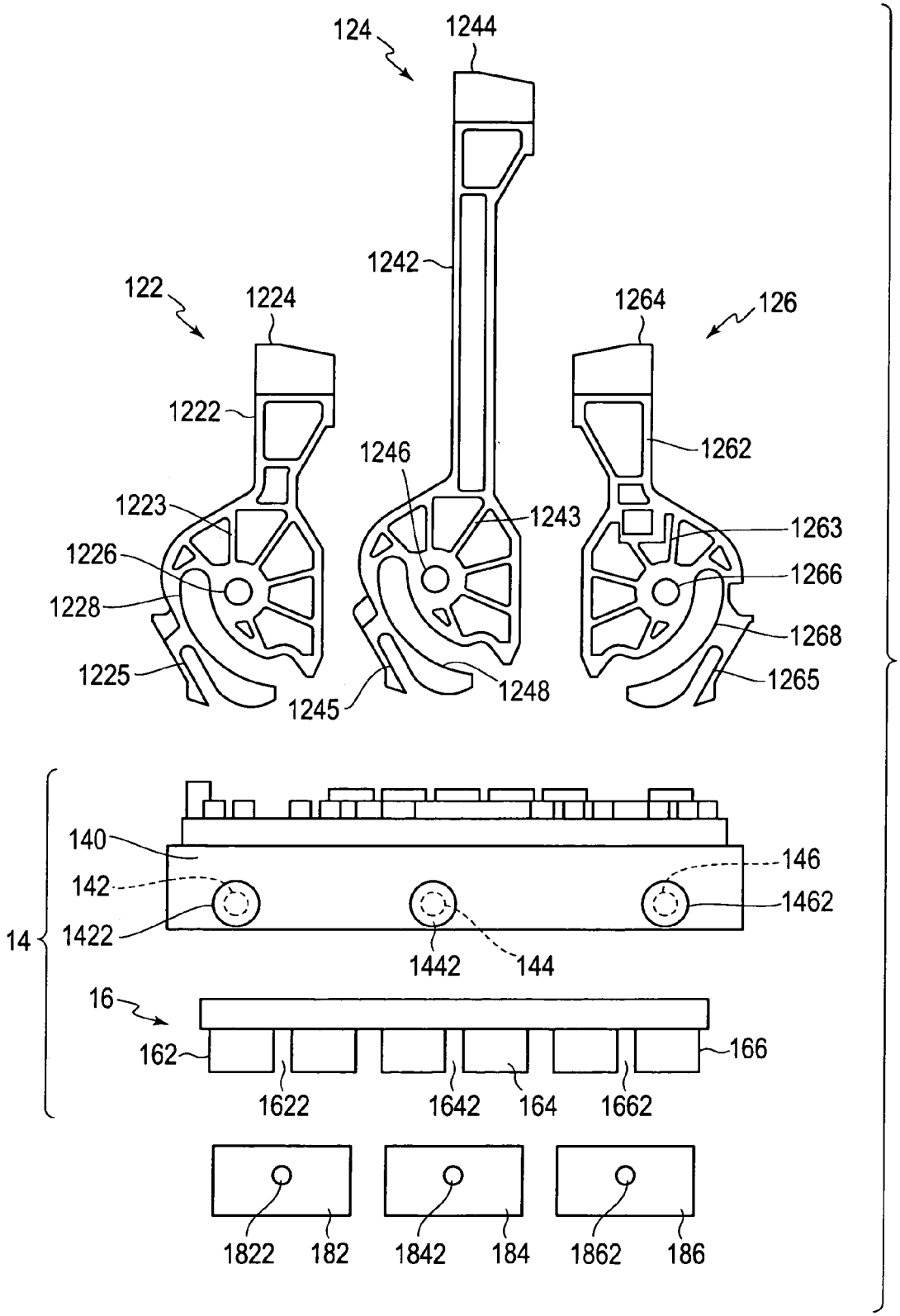
FIG. 2 is an elevation view of various parts of the junction block assembly of FIG. 1, in a disassembled state.

FIG. 1 is a perspective view of a junction block assembly 10. As shown in FIG. 2, the junction block assembly 10 includes cam levers 122, 124 and 126, a junction block 14, and connectors 182, 184 and 186. The junction block 14 includes connectors 162, 164 and 166, which mate respectively with the connectors 182, 184 and 186. The connectors 182, 184 and 186 may be assembled together in a connector assembly 16. The junction block 14 may also include a junction block base 140. Various parts of the junction block assembly 10 may be made of plastic or any other suitable material. The junction block assembly 10 may include relays, fuses and/or other electrical devices (not labeled), installed as appropriate to make various desired connections between terminals of the connectors 162, 164 and/or 166. The junction block assembly 10 may include one or more cover members (not shown), or may be accommodated in an outer casing (not shown).

The cam levers 122, 124 and 126 respectively include arms 1222, 1242 and 1262. As shown best in FIG. 1, the arms of each cam lever include a pair of parallel arms respectively joined by connection members 1224, 1244 and 1264. The arms 1242 and connection member 1244 of the cam lever 124 are longer than the arms 1222 and connection member 1224, respectively, of the cam lever 122.

As shown in FIG. 2, mounting holes 1226, 1246 and 1266 are provided respectively in the cam levers 122, 124 and 126 for rotatably mounting the cam levers 122, 124 and 126 respectively to mounting posts 142, 144 and 146 that are provided on the junction block 14. In this embodiment, the mounting posts 142, 144 and 146 are provided on the junction block base 140 of the junction block 14. In other embodiments, the mounting posts 142, 144 and 146 could be provided on an upper portion of the connector assembly 16 of the junction block 14. Although not fully depicted, it will be appreciated that in this embodiment, the mounting posts 142, 144 and 146 are provided in pairs on opposite sides of the junction block 14, i.e., each of the depicted mounting posts 142, 144 and 146 is paired with a corresponding mounting post provided on the undepicted opposite side of the junction block 14. The mounting posts 144 in this embodiment are longer than the mounting posts 142 and 146, to allow the arms 1242 of the cam lever 124 to travel past the arms 1222 of the cam lever 122. However, in other embodiments, the mounting posts may all be made the same length, and the arms 1242 of the cam lever 124 may be formed so as to curve inward to the junction block 14 at the attachment end so as to reach the mounting posts 144, while still being far enough from the junction block at other points to travel past the arms 1222 of the cam lever 122.

The mounting posts 142, 144 and 146 may have flanges 1422, 1442 and 1462, respectively, which restrict the cam levers 122, 124 and 126 from being easily pulled off after assembly. To facilitate assembly, the mounting posts 142, 144 and 146 and/or flanges 1422, 1424 and 1426 may have any known or later-developed configuration. For example, the mounting posts 142, 144 and 146 may have slotted ends (not shown), such that tips of the mounting posts 142, 144 and 146 can be slightly squeezed together to allow the tips of the mounting posts 142, 144 and 146 to pass through the mounting holes. As another example, the relative sizes of the flanges 1422, 1424 and 1426 and the mounting holes 1226, 1246 and 1266 may be set such that the flanges 1422, 1424 and 1426 can resiliently deform to pass respectively through the mounting holes 1226, 1246 and 1266.

The cam levers 122, 124 and 126 respectively include cam grooves 1228, 1248 and 1268, which engage respectively with cam posts 1822, 1842 and 1862 provided respectively on the connectors 182, 184 and 186, as described in more detail below. The cam levers 122, 124 and 126 may also include stiffening ribs 1223, 1243 and 1263 to strengthen various portions of the cam levers 122, 124 and 126.

The cam levers 122, 124 and 126 may also respectively include detent mechanisms 1225, 1245 and 1265. The detent mechanisms 1225, 1245 and 1265 may resiliently engage with corresponding pins or the like (not shown) provided on the junction block 14, or on another surrounding structure, to hold the cam levers 122, 124 and 126 in a pre-staged position (e.g., the position shown in FIG. 3) and/or in a fully engaged position (e.g., the position shown in FIG. 5).

The connector assembly 16 may be attached to the junction block base 140 by any suitable mechanism, such as, for example, resilient locking members (not shown). In this embodiment, the connectors 182, 184 and 186 respectively fit inside the connectors 162, 164 and 166. The connectors 162, 164 and 166 have respective slots 1622, 1642 and 1662 through which the cam posts 1822, 1842 and 1862 of the connectors 182, 184 and 186 laterally slide during connection of the connectors 162, 164 and 166 with the connectors 182, 184 and 186. It will be appreciated that if the connectors 182, 184 and 186 respectively fit over, rather than inside, the connectors 162, 164 and 166, then the slots 1622, 1642 and 1662 will not be needed.

Figure 3:
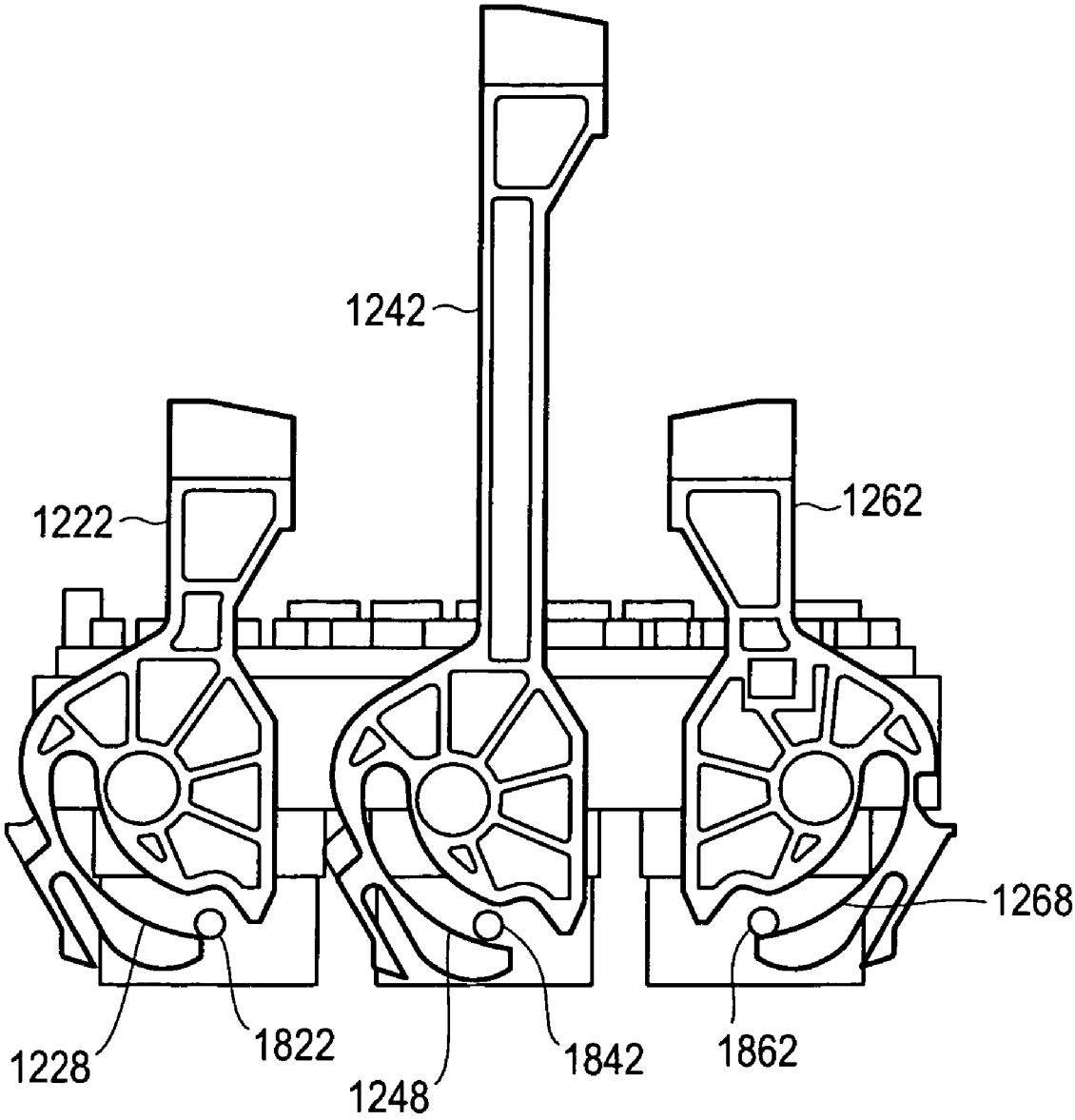
FIG. 3 is an elevation view that illustrates an initial engagement state of connectors of the junction block assembly of FIG. 1.

FIG. 3 is an elevation view that illustrates an initial engagement state of the connectors 162, 164 and 166 with the connectors 182, 184 and 186. In this initial state, the cam posts 1822, 1842 and 1862 of the connectors 182, 184 and 186 engage open ends of the cam grooves 1228, 1248 and 1268 cam levers 122, 124 and 126. An assembly technician can easily confirm alignment of the connectors, simply by observing the relative positions of the cam levers 122, 124 and 126 and cam posts 1822, 1842 and 1862.

Figure 4:
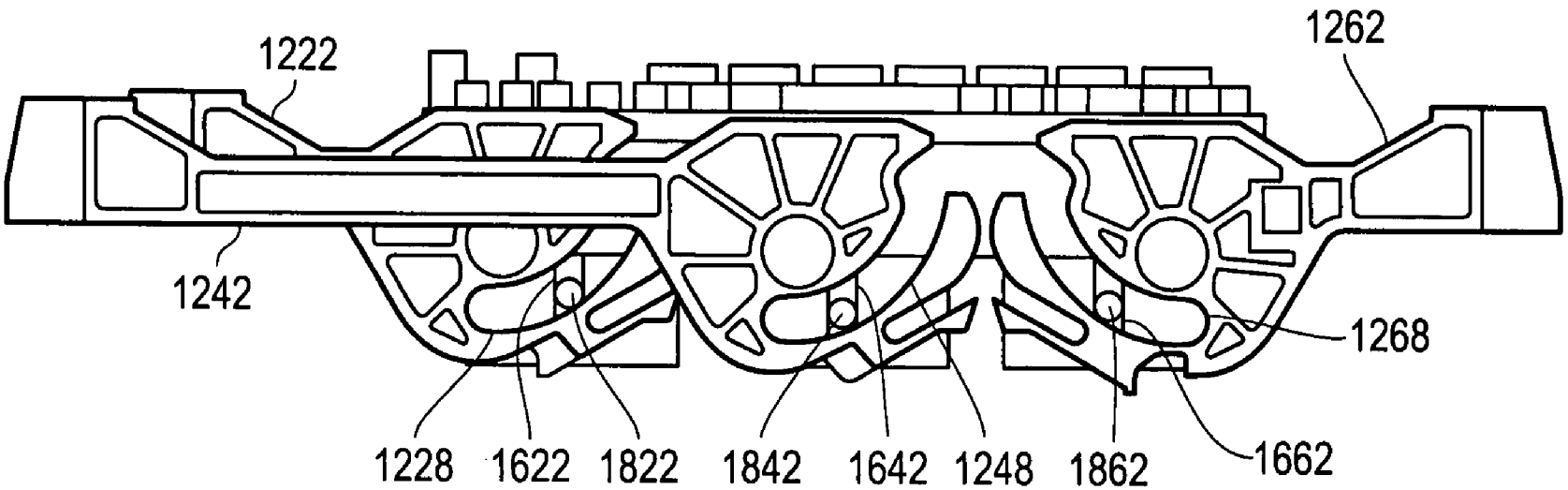
FIG. 4 is an elevation view that illustrates an intermediate engagement state of connectors of the junction block assembly of FIG. 1.

FIG. 4 is an elevation view that illustrates an intermediate engagement state of the connectors 162, 164 and 166 with the connectors 182, 184 and 186. In this state, the cam levers 122 and 124 have been rotated counter-clockwise, and the cam lever 126 has been rotated clockwise, thereby pulling the connectors 182, 184 and 186 into partial connection with the connectors 162, 164 and 166, respectively. As depicted, the arms 1242 of the cam lever 124 travel past the arms 1222 of the cam lever 122 during rotation.

Figure 5:
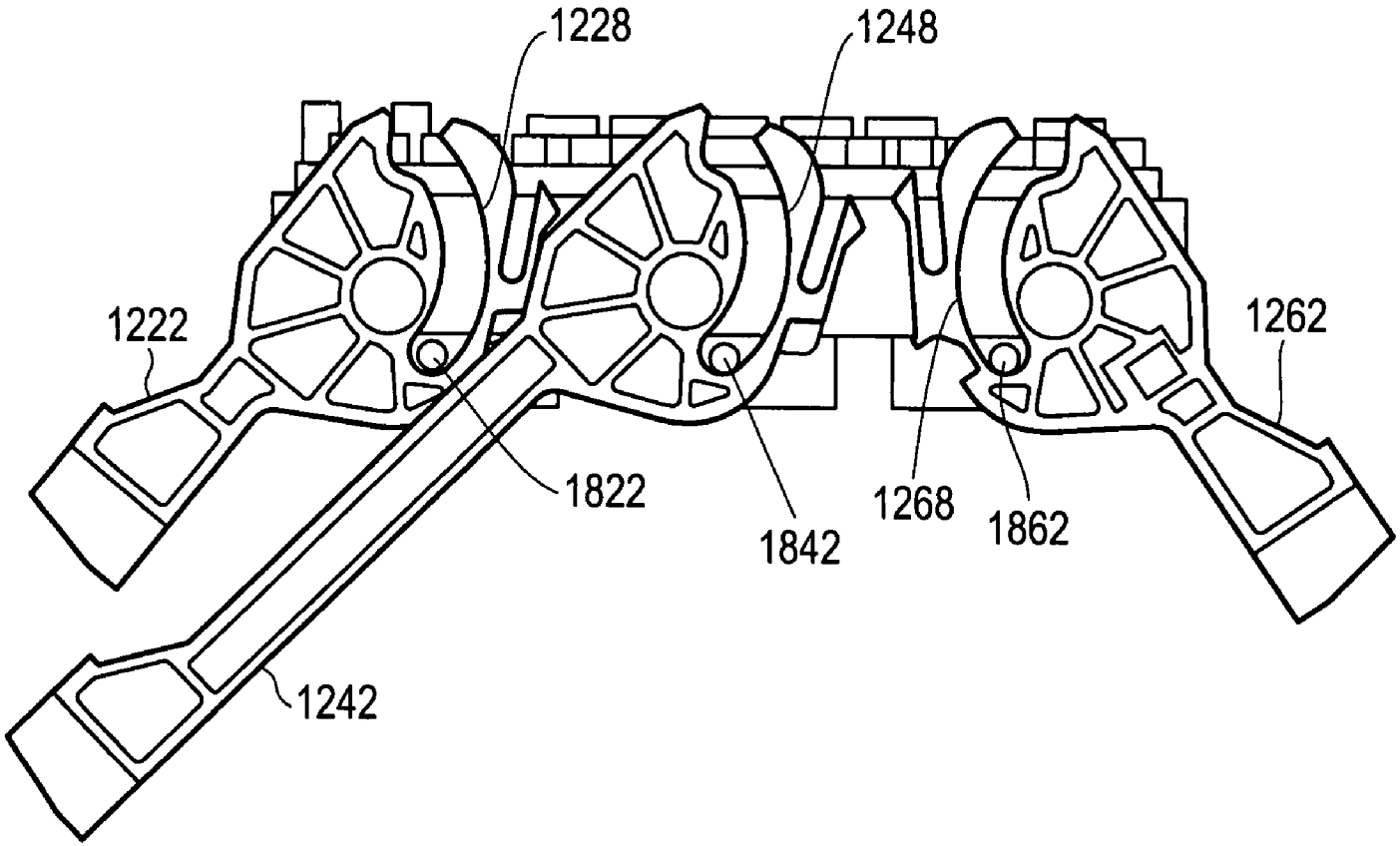
FIG. 5 is an elevation view that illustrates a final, complete engagement state of connectors of the junction block assembly of FIG. 1.

FIG. 5 is an elevation view that illustrates a final engagement state of the connectors 162, 164 and 166 with the connectors 182, 184 and 186. In this state, the cam levers 122 and 124 have been further rotated counter-clockwise, and the cam lever 126 has been further rotated clockwise, thereby pulling the connectors 182, 184 and 186 into complete connection with the connectors 162, 164 and 166, respectively.

During the above-described engagement, the connectors 182, 184 and 186 move independently of each other while being pulled into connection with mating ones of the connectors 162, 164 and 166. This is advantageous because the force of each cam lever 122, 124 and 126 may be concentrated on a single connector 182, 184 or 186, without having to simultaneously coordinate the movement of the cam levers 122, 124 and 126.

When the cam levers 122, 124 and 126 have reached the final positions shown in FIG. 5, the assembly technician can easily confirm complete engagement of the connectors simply by observing and/or feeling that the cam levers 122, 124 and 126 have reached their full length of travel in the engagement direction.

It will be appreciated that, to disengage the connectors, the cam levers 122, 124 and 126 are rotated in the directions opposite to their respective engagement directions.

While specific embodiments have been described, these embodiments should be viewed as illustrative and not limiting. Various changes, substitutes, improvements or the like are possible within the spirit and scope of the invention.

What is claimed is:

1. A junction block assembly, comprising:

a junction block holding at least two first connectors;

at least two second connectors that mate with the first connectors;

a first cam lever rotatably mounted to the junction block, the first cam lever engaging one of the second connectors and pulling the engaged second connector into connection with a mating one of the first connectors during rotation of the first cam lever; and a second cam lever rotatably mounted to the junction block, the second cam lever engaging one of the second connectors and pulling the engaged second connector into connection with a mating one of the first connectors during rotation of the second cam lever;

wherein an arm of the second cam lever travels past an arm of the first cam lever during rotation; and wherein the first and second cam levers each include two parallel arms joined by a connection member, the arms and connection member of the second cam lever being longer than the arms and connection member, respectively, of the first cam lever.

2. The junction block assembly of claim 1, further comprising a third cam lever rotatably mounted to the junction block, the third cam lever engaging one of the second connectors and pulling the engaged second connector into connection with a mating one of the first connectors during rotation of the third cam lever, wherein a rotation direction of the third cam lever that pulls the engaged second connector into a connected state is opposite to a rotation direction of the first and second cam levers that pulls the engaged first and second connectors into a connected state.

3. The junction block assembly of claim 1, wherein the second connectors move independently of each other while being pulled into connection with mating ones of the first connectors.

4. A vehicle in which is mounted the junction block assembly of claim 1.

5. A junction block assembly, comprising:

a junction block holding at least two first connectors;

at least two second connectors that mate with the first connectors;

a first cam lever rotatably mounted to the junction block, the first cam lever engaging one of the second connectors and pulling the engaged second connector into connection with a mating one of the first connectors during rotation of the first cam lever; and a second cam lever rotatably mounted to the junction block, the second cam lever engaging one of the second connectors and pulling the engaged second connector into connection with a mating one of the first connectors during rotation of the second cam lever;

wherein an arm of the second cam lever travels past an arm of the first cam lever during rotation; and a third cam lever rotatably mounted to the junction block, the third cam lever engaging one of the second connectors and pulling the engaged second connector into connection with a mating one of the first connectors during rotation of the third cam lever, wherein a rotation direction of the third cam lever that pulls the engaged second connector into a connected state is opposite to a rotation direction of the first and second cam levers that pulls the engaged first and second connectors into a connected state.

6. A vehicle in which is mounted the junction block assembly of claim 5.

7. A junction block assembly, comprising:

a junction block holding at least two first connectors;

at least two second connectors that mate with the first connectors;

a first cam lever rotatably mounted to the junction block, the first cam lever engaging one of the second connectors and pulling the engaged second connector into connection with a mating one of the first connectors during rotation of the first cam lever; and a second cam lever rotatably mounted to the junction block, the second cam lever engaging one of the second connectors and pulling the engaged second connector into connection with a mating one of the first connectors during rotation of the second cam lever;

wherein an arm of the second cam lever travels past an arm of the first cam lever during rotation; and wherein the second connectors move independently of each other while being pulled into connection with mating ones of the first connectors.

8. A vehicle in which is mounted the junction block assembly of claim 7.

* * * * *